United States Patent [19]

Watanabe et al.

[11] Patent Number: 4,478,804

[45] Date of Patent: Oct. 23, 1984

[54] RECOVERY PROCESS OF URANIUM

[75] Inventors: Morio Watanabe, Hyogo; Sanji Nishimura, Kyoto, both of Japan

[73] Assignee: Solex Research Corporation, Tokyo, Japan

[21] Appl. No.: 411,353

[22] Filed: Aug. 25, 1982

[30] Foreign Application Priority Data

Sep. 2, 1981 [JP] Japan ..... 56-136979

[51] Int. Cl.[3] ..... C01G 43/00

[52] U.S. Cl. ..... 423/259; 423/8; 423/9; 423/10; 423/253; 423/260

[58] Field of Search ..... 423/8–11, 423/253, 259, 260

[56] References Cited

U.S. PATENT DOCUMENTS

| | | | |
|---|---|---|---|
| 2,835,552 | 5/1958 | McGinnis | 423/259 |
| 2,882,123 | 4/1959 | Long | 423/10 |
| 3,120,994 | 2/1964 | Brodsky et al. | 423/253 |
| 3,681,035 | 8/1972 | Selman et al. | 423/253 |
| 4,207,294 | 6/1980 | Hirono | 423/11 |

FOREIGN PATENT DOCUMENTS

| | | | |
|---|---|---|---|
| 855446 | 5/1957 | United Kingdom | 423/259 |

OTHER PUBLICATIONS

Peterson et al., "Chemistry in Nuclear Technology", pp. 135–136, Addison-Wesley Publ. Co., Inc. (1963) Reading, Mass.

*Primary Examiner*—Edward A. Miller

[57] ABSTRACT

A recovery process of uranium comprising:

(1) extracting uranium ions with an organic solvent containing one or more compounds selected from the group consisting of alkyl phosphoric acid, alkyl-aryl phosphoric acid, alkyl dithio phosphoric acid, aryl dithio phosphoric acid, neutral phosphoric acid ester and alkyl amine together with a petroleum hydrocarbon as a diluent; and (2) stripping the uranium ions in the resultant organic solvent from the step (1) to an aqueous phase with contact of an aqueous solution containing one or more compounds selected from the groups of $NH_4F$, $NH_4HF_2$, KF or $KHF_2$.

3 Claims, 9 Drawing Figures

RECOVERY PROCESS OF URANIUM

BACKGROUND OF THE INVENTION

1. Field of the Invention

This invention relates to a process in which uranium extracted to an organic solvent is stripped and recovered from an organic phase to an aqueous phase.

2. Description of the Prior Arts

Conventionally Amex process using alkyl amine and Purex process using neutral phosphoric acid ester are well known as a process for separation and purification of uranium existing in an aqueous solution. In the former, uranium in an aqueous solution is extracted into an organic phase as uranyl sulphate by using an organic solvent containing alkyl amine and after conversion of the extracted uranyl sulphate to uranyl chloride with contact of hydrochloric acid, the resultant uranyl chloride is stripped to the aqueous phase with contact of water. While, the latter is a typical process used for retreatment process of nuclear fuel. In this process uranyl nitrate and uranous nitrate are extracted and plutonium is separated after conversion of its valency. The extracted uranyl nitrate is separated and purified from the other ions by stripping from the organic phase to the aqueous phase with contact of water.

These processes, however, have the following disadvantage. The aqueous strip solution containing uranium value is neutralized with $NH_3$ or uranium is precipitated and filtered as $UF_4$ by addition of HF after reduction process and consequently the filtrate after recovery of uranium value as a solid must be discharged out from the system.

In production of phosphoric acid by wet process, an aqueous solution (crude phosphoric acid) obtained by dissolution of phosphorus ore with $H_2SO_4$ generally contains about 0.1 g/l of uranium. U.S. Pat. Nos. 3,711,591 and 3,835,214 disclose well known processes for recovery of uranium from the crude phosphoric acid. In the former uranium in the phosphoric acid solution is oxidised to $U^{6+}$ ion, while in the latter uranium is reduced to $U^{4+}$ ion. Uranium in both processes is extracted by organic solvent and stripped to the aqueous phase after conversion of valency of uranium extracted in the organic phase by either reduction or oxidation.

These processes have the following disadvantages:

(1) Operation is complicate.

(2) Phosphoric acid solution after extraction of uranium is contaminated by iron and $NaClO_3$ using for conversion of uranium ion valency.

(3) One additive process is needed to treat the aqueous solution containing uranium after stripping stage.

Japanese Laid-Open Patent Application Sho 53-128596 discloses a process proposed to overcome the disadvantages of U.S. patents described above. In this patent application $U^{6+}$ and $U^{4+}$ ions in the aqueous solution (crude phosphoric acid) can be extracted using mixture of extractants used in the above U.S. patents and this process is different from U.S. patents processes in that it uses $H_2SO_4$+HF mixture in order to strip uranium in the organic phase to the aqueous phase. In this process the stripped uranium value can be filtered and recovered as a precipitate of uranium fluoride and consequently the total process is shortened. However, in the stripping stage HF in the strip solution ($HF+H_2SO_4$) is extracted to the organic phase by 0.02–0.04M tri-octyl phosphine oxide (TOPO) using as an extractant and this HF in the organic phase contaminates phosphoric acid solution with contact of crude phosphoric acid and the organic solvent. The contamination of phosphoric acid by HF and large loss of HF reduce an economical value of this process.

SUMMARY OF THE INVENTION

This invention proposes a process in which uranium value contained in aqueous solutions is extracted to an organic solvent and the extracted uranium is stripped and recovered to the aqueous phase as uranium ammonium fluoride uranium acid ammonium fluoride, uranium potassium fluoride or uranium acid potassium fluoride with contact of aqueous solution (strip solution) containing one or more compounds selected from $NH_4F$, $NH_4HF_2$, KF or $KHF_2$ in order to overcome disadvantages of the conventional processes.

DETAILED DESCRIPTION OF THE PREFERRED EMBODIMENTS

Figure 1:
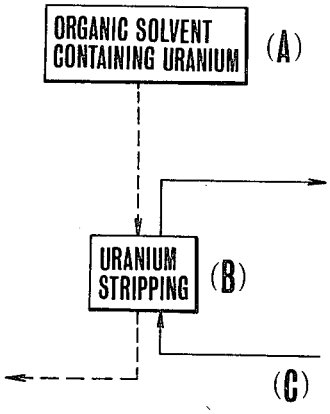
FIGS. 1 to 4 show the process flow sheets of this invention.

In this invention uranium value ($U^{4+}$, $UO_2^{2+}$, etc.) extracted to an organic solvent containing one or more compounds selected from the groups of alkyl phosphoric acid, alkyl-aryl phosphoric acid, alkyl dithio phosphoric acid, aryl dithio phosphoric acid, neutral phosphoric acid ester and alkyl amine together with a petroleum hydrocarbon as a diluent is stripped and recovered to an aqueous phase with contact of aqueous solution (strip solution) containing one or more compounds selected from $NH_4F$, $NH_4HF_2$, KF or $KHF_2$.

This invention is extremely different from U.S. Pat. Nos. 3,711,591 and 3,835,214 and Japanese Laid-Open Patent Application Sho 53-128596 in the stripping stage of the extracted uranium. In the present invention both $U^{6+}$ and $U^{4'}$ ions in the organic solvent can be stripped to the aqueous phase using aqueous solution (strip solution) containing one or more compounds selected from $NH_4F$, $NH_4HF_2$, KF or $KHF_2$. HF is not extracted to the organic phase in the stripping stage and uranium value stripped to the aqueous phase can be recovered as double salt of uranium ammonium fluoride, uranium acid ammonium fluoride, uranium potassium fluoride or uranium acid potassium fluoride.

Since the recovered double salts have a large crystallization velocity, recrystallization operation is very easy and consequently it is very easy to improve the purity of recovered uranium value. Moreover, the organic solvents used in this process can be the same one described above.

Extraction Stage

The typical extraction reactions of uranium from the aqueous solution containing uranium are shown in the following equations:

$$UO_2(SO_4)_3^{4-}+2(R_3NH)_2SO_4 \rightleftharpoons (R_3NH)_4UO_2(SO_4)_3+2SO_4^{2-} \quad (1)$$

$$UO_2^{2+}+2R.NH_4 \rightleftharpoons R_2UO_2+2NH_4^+ \quad (2)$$

$$UO_2^{2+}+R.NH_4+R.H \rightleftharpoons R_2UO_2+NH_4^++H^+ \quad (3)$$

$$UO_2(NO_3)_2+2TBP \rightleftharpoons UO_2(NO_3)_2.2TBP \quad (4)$$

$$U^{4+}+4R.H \rightleftharpoons R_4U+4H^+ \quad (5)$$

$$UCl_4+2TBP \rightleftharpoons UCl_4.2TBP \quad (6)$$

where R.H is H type-extractant, $RNH_4$ is $NH_4$ type-extractant, TBP is tri-butyl phosphate.

Stripping Stage

In the following stripping stage uranium value extracted to the organic phase is stripped with contact of aqueous solution containing one or more compounds selected from $NH_4F$, $NH_4HF_2$, KF or $KHF_2$ and the crystals such as uranium ammonium fluoride are produced as shown in equations (7)–(11).

The typical stripping reactions in the stripping stage are shown in the following expressions:

$$(R_3NH)_4UO_2(SO_4)_3+6NH_4F \rightleftharpoons 4R_3N+2H_2SO_4+(NH_4)_2SO_4+(NH_4)_4UO_2F_6\downarrow \quad (7)$$

$$R_2UO_2+6NH_4F \rightleftharpoons 2R.NH_4+(NH_4)_4UO_2F_6\downarrow \quad (8)$$

$$R_2UO_2+6KF \rightleftharpoons 2R.K+(K)_4UO_2F_6\downarrow \quad (9)$$

$$UO_2(NO_3)_2.2TBP+6NH_4F \rightleftharpoons 2TBP+2NH_4NO_3+(NH_4)_4UO_2F_6 \rightleftharpoons \quad (10)$$

$$R_4U+3NH_4HF_2 \rightleftharpoons 3RNH_4+(NH_4)_2UF_6\downarrow \quad (11)$$

Neutral phosphoric acid esters and alkyl amines in the organic solvent extract HF in the strip solution below pH 7 of strip solution as shown in equations (12)–(14):

$$2F^-+2H^++2TOPO \rightleftharpoons 2(HF.TOPO) \quad (12)$$

$$2F^-+2H^++2TBP \rightleftharpoons 2(HF+TBP) \quad (13)$$

$$2F^-+2H^++2R_3N \rightleftharpoons 2((R_3NH^+)F^-) \quad (14)$$

Figure 6:
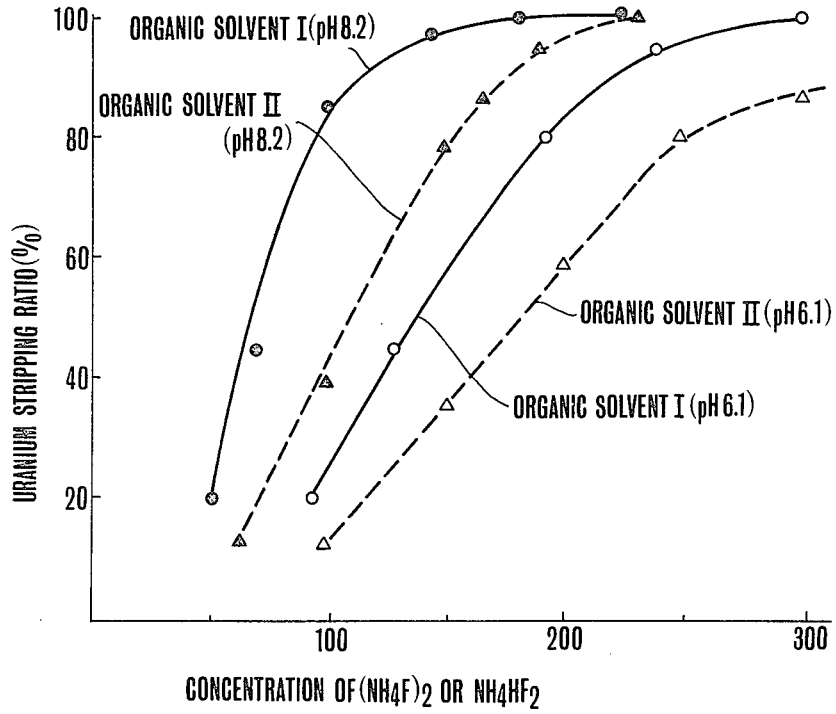
FIG. 6 is a graph showing the relation between concentration of $(NH_4F)_2$ or $NH_4HF_2$ in the strip solution and stripping percent of uranium.

As shown in Japanese Laid-Open Patent Application Sho 53-128596, the distribution ratio of HF rapidly increases with enhancement of $H_2SO_4$ existing with HF in the strip solution. However, in this invention, the extracted amount of HF with the organic solvent can be controlled by means of high stripability of uranium in the organic phase in a higher pH region as shown in FIG. 6.

Figure 8:
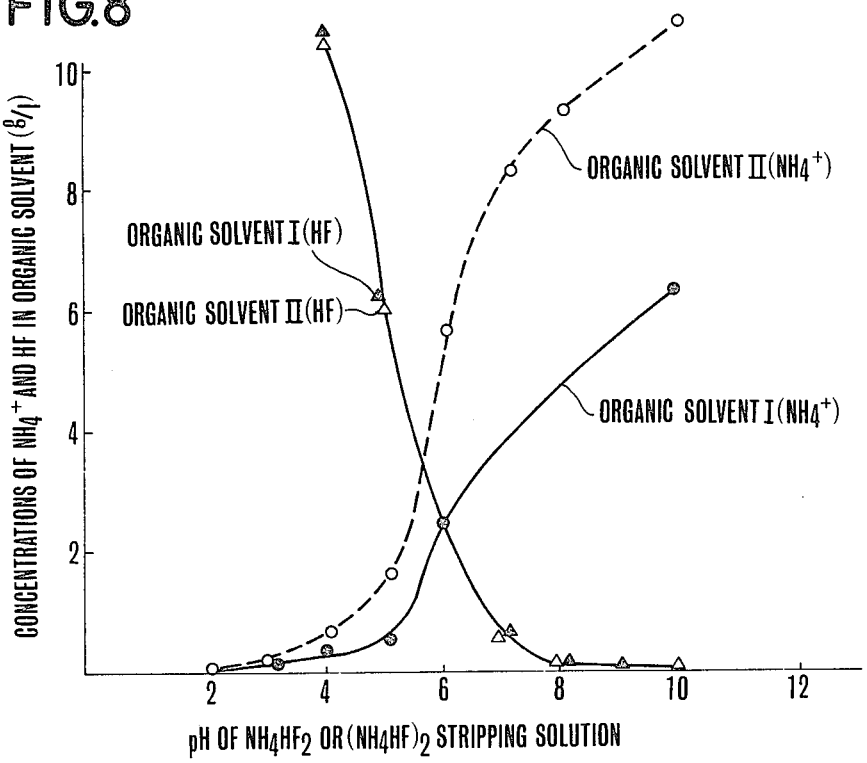
FIG. 8 shows the influence of pH value on amount of $NH_4+$ and HF extracted to the organic solvent.

The extraction reactions shown in equations (12)–(14) do not take place at higher pH values of the strip solution and $NH_4$ type-extractant increases as shown in equation (8). FIG. 8 indicates this relationship. Increasing the pH value of strip solution in order to control HF extraction enhances stripability, but $NH_4$ type-extractant increases. This extractant transfers from the organic phase to the aqueous phase in the extraction stage and consequently the aqueous strip solution is contaminated after the extraction stage. When this contamination causes trouble, the $NH_4$ type-extractant is converted to H type-extractant with contact of mineral acid such as HCl or $H_2SO_4$ before uranium extraction as shown in the following equation.

$$R.NH_4+HCl \rightleftharpoons R.H+NH_4Cl \quad (15)$$

The produced $NH_4Cl$ is neutralized with $Ca(OH)_2$ or NaOH and $NH_4OH$ can be recovered by heating and distillation.

As shown in equations (8)–(11), uranium values transferred from the organic phase to the aqueous phase are not limited to chemical species shown in each equation and can be $MUF_5$, $M_2UF_6$, $M_2UOF_6$, $MUOF_3$, $MUO_2F_3$, $M_2UO_2F_5$, $M_4UO_2F_6$, $M_3U_2O_4F_7$, $M_3U_2O_4F_9$, etc. (M shows $NH_4$ or K). Furthermore, the mixtures of the above compounds are also produced.

Each concentration of KF, $KHF_2$, $NH_4F$ or $NH_4HF_2$ as strip agent used to strip uranium in the organic solvent is required to be above 1 mol/l. A high concentration and a high pH value of the strip solution enhance stripability per one stage and temperature of the strip solution has scarce influence.

The uranium containing organic solvent used in this invention can be produced by contacting HCl, $HNO_3$, $H_2SO_4$ and $H_3PO_4$ solutions containing uranium with the organic solvent containing one or more compounds selected from the groups of alkyl phosphoric acid, alkyl-aryl phosphoric acid, alkyl or aryl dithio phosphoric acid, neutral phosphoric acid ester or alkyl amine together with a petroleum hydrocarbon as a diluent.

In general, enhancement of the uranium purity extracted to the organic phase is accomplished by scrubbing the organic phase with water, etc. Mixed ratio of the extractants is controlled by existing ratio of $U^{4+}$ and $U^{6+}$ ions in the uranium value extracted to the organic phase. For example, much $U^{4+}$ ions increases mixed ratio of octyl phenyl phosphoric acid (OPPA). Also kind and concentration of the extractant are changed by kind of other heavy metallic ions coexisting with uranium ions. Moreover, improvement of recovered uranium grade can be accomplished by dissociation of double salts ($MUF_5$, $M_2UF_6$, $M[UO_2F_3]$, $M_4[UO_2F_6]$, $M_2[UO_2F_5]$) obtained with contact of the aqueous solution containing $NH_4F$, $NH_4HF_2$, KF or $KHF_2$ and repeated recrystallization. Especially, crystallization velocity of uranium ammonium fluoride and uranium acid ammonium fluoride is fast and it is very easy to improve the recovered uranium purity by recrystallization operation. Moreover, dissociation of the above compounds to $UF_4$ and $UO_2$ is occurred in at comparatively lower temperature and treated materials are not discharged out from the system by recovery and reuse of decomposed gas.

As described above, this invention has the following advantages in comparison with Japanese Laid-Open Patent Application Sho 53-128596:

(1) less amount of HF extracted to the organic phase in the stripping stage of uranium in the organic phase.

(2) recycling of $NH_4F$ and KF used for stripping operation is possible.

(3) uranium value can be collected in the solid form as double salt having a fast crystallization velocity.

(4) high purity uranium can be obtained by redissociation and recrystallization.

(5) recovered chemical species such as $UF_4$ or $UO_2$ can be freely selected by atmosphere used in thermal decomposition as shown in equations (16)-(19).

$$(NH_4)_2UF_6+2H_2O \rightleftharpoons 2NH_4F+4HF+UO_2 \quad (16)$$

$$NH_4[UO_2F_3]+H_2 \rightleftharpoons NH_4F+2HF+UO_2 \quad (17)$$

$$(NH_4)_2UOF_6+H_2 \rightleftharpoons 2(NH_4F)+UF_4+H_2O \quad (18)$$

$$K_2[UO_2F_5]+N_2 \rightleftharpoons 2KF+3F+UO_2 \quad (19)$$

The above equations only indicate one example. $NH_4F$, HF, F and $NH_3$ generated in the thermal decomposition in spite of using atmosphere can be easily absorbed with water and reused for stripping uranium in the organic phase.

Organic extractants used for extraction of uranium in this invention are shown as below.

The group of alkyl phosphoric acid are selected from the compounds shown in (A)-(F).

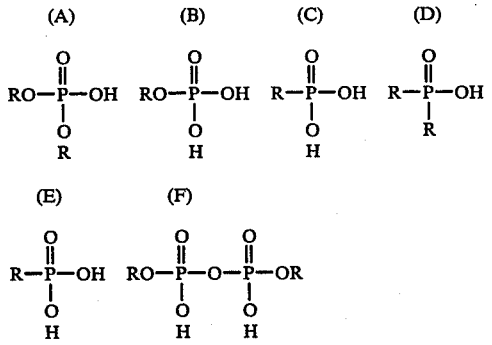

where R is alkyl radical having 4 to 18 carbon atoms.

Di-2-ethylhexyl phosphoric acid (D2EHPA) shown in the practical example belongs to the group (A) and its alkyl radical is $C_8H_{17}$.

Alkyl-aryl phosphoric acids used in this invention are selected from the following groups.

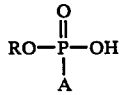

where R is alkyl radical having 4 to 18 carbon atoms. A is aryl radical (phenyl, triyl and xylyl, etc.).

Octyl phenyl phosphoric acid (OPPA) shown in the latter practical example has $R=C_8H_{17}$ and $A=C_6H_5$.

Alkyl dithio phosphoric acid and aryl dithio phosphoric acid used in this invention are selected from the following compound.

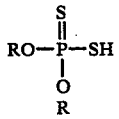

where R is alkyl or aryl radicals having 4 to 18 carbon atoms.

Di-2-ethylhexyl dithio phosphoric acid (D2EHDTPA) shown in the latter practical example has $R=C_8H_{17}$.

Neutral phosphoric acid esters used in this invention are selected from the following groups (A)-(D):

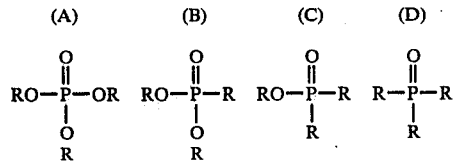

where R is alkyl radical having 4 to 18 carbon atoms.

TBP indicated in the latter practical example belongs to the group (A) and has $R=C_4H_9$ and TOPO belongs to the group (D) and has $R=C_8H_{17}$.

Alkyl amines used in this invention are selected from the following groups (primary amine, secondary amine and tertiary amine). Primary amine is represented as $RNH_2$ and R is alkyl radical having 4 to 24 carbon atoms. The typical primary amine is shown below:

$$CH_3C(CH_3)_2CH_2C(CH_3)_2CH_2C(CH_3)_2CH_2C(CH_3)_2CH_2C(CH_3)_2NH_2$$

Secondary amine is represented as $R_2NH$ and R is alkyl radical having 4 to 24 carbon atoms.

The typical secondary amine is shown below:

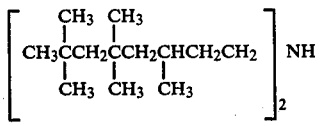

Tertiary amine is represented as $R_3N$ and R is alkyl radical having 4 to 22 carbon atoms. The typical tertiary amine is shown below:

$$[CH_3CH_2CH_2CH_2CH_2CH_2CH_2CH_2]_3N$$

Aromatic hydrocarbon and aliphatic hydrocarbon are used as a diluent. Mixtures of the above hydrocarbons are also used and other mixtures of various hydrocarbons such as kerosene are widely used.

The concentration of extractant in the organic solvent is 2-90 volume percent. As occasion demands high molecular weight alcohols having 8 to 34 carbon atoms are added as a modifier.

The concentration of extractant is determined according to the concentration of uranium in the aqueous solution, heavy metallic ions coexisting and anions and characteristics of chemical species.

The organic solvent extracted uranium, the raw material in this invention, is produced by contacting aqueous HCl, $H_2SO_4$, $HNO_3$ or $H_3PO_4$ solution containing uranium with an organic solvent containing one or more compounds selected from the groups of alkyl phosphoric acid, alkyl-aryl phosphoric acid, alkyl or aryl dithio phosphoric acid, neutral phosphoric acid ester and alkyl amine together with a petroleum hydrocarbon as a diluent.

The detailed description of this invention will be embodimently explained on the basis of the attached graphs. However, this invention is not limited by only this explanation.

Figure 2:
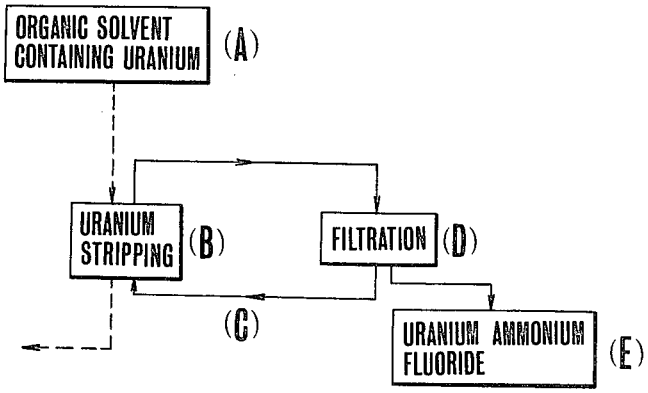

As shown in flow sheets of FIGS. 1 and 2, an organic solvent (A) containing uranium is introduced to the stripping stage (B), uranium is stripped from the organic phase to the aqueous phase with contact of the strip solution (C) containing one or more compounds selected from $NH_4F$, $NH_4HF_2$, KF and $KHF_2$ and the crystals (E) such as uranium ammonium fluoride, uranium acid ammonium fluoride, uranium potassium fluoride and uranium acid potassium fluoride are obtained in the filtration stage of uranium transferred to the aqueous phase.

Figure 3:
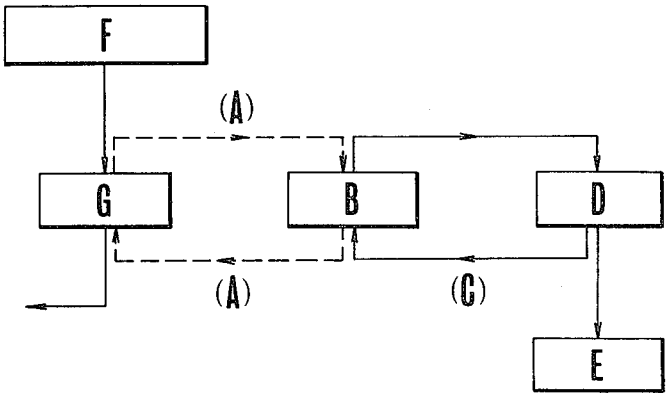

Flow sheet in FIG. 3 indicates one production process of purified uranium ammonium fluoride, uranium acid ammonium fluoride, uranium potassium fluoride and uranium acid potassium fluoride from an aqueous solution containing uranium.

Aqueous solution (F) containing uranium is introduced to the extraction stage (G), uranium is extracted from the aqueous phase to the organic phase with contact of the organic solvent (A) and in the stripping stage (B) uranium is transferred from the organic phase to the aqueous phase with contact of water. The organic solvent (A) is regenerated and recycled to the uranium extraction stage. While, uranium transferred to the aqueous phase (C) is recovered as the crystals (E) such as uranium ammonium fluoride, uranium acid ammonium fluoride, uranium potassium fluoride and uranium acid potassium fluoride in the filtration stage (D).

Figure 4:
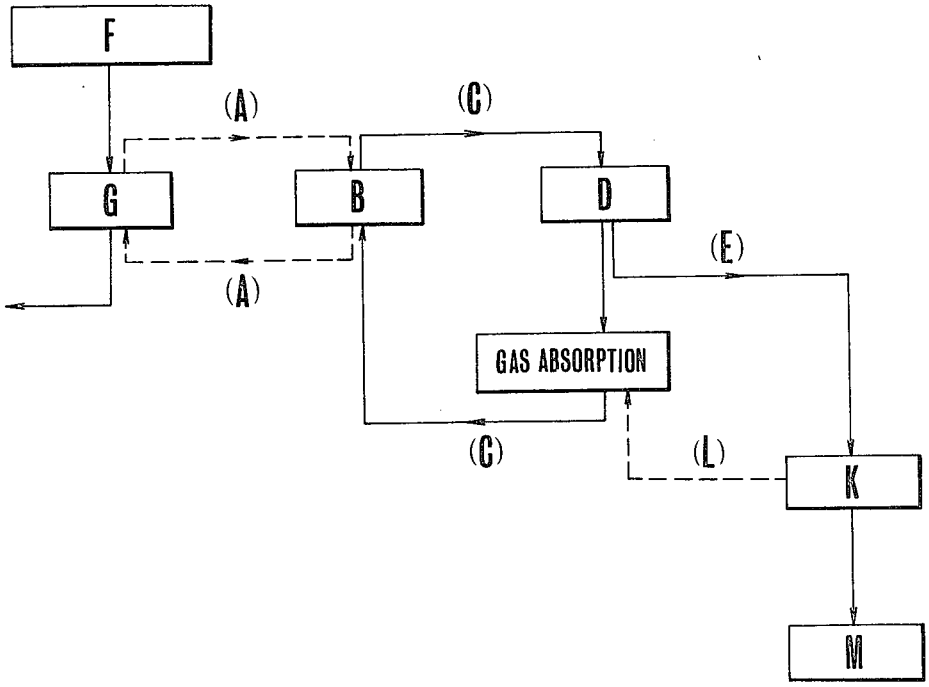

Flow sheet in FIG. 4 is the same one in FIG. 3 but indicates the additional treatment process of the crystals (E) such as recovered uranium ammonium fluoride, etc. The crystals (E), such as uranium ammonium fluoride, uranium acid ammonium fluoride, uranium potassium fluoride and uranium acid potassium fluoride, separated from the strip solution (C) is thermal decomposed in gas stream containing oxygen and water, hydrogen stream or insert gas stream as shown in equations (16)-(19) and uranium oxide can be obtained in gas stream containing oxygen and water, uranium fluoride in hydrogen stream and uranium fluoride or uranium oxide (M) in inert gas stream. $NH_4F$, KF, $NH_3$, HF and F gases generated in thermal decomposition are absorbed with water and reused for the stripping stage of uranium in the organic phase (B) as a strip solution (C).

This invention has the following advantages:

(1) High purity uranium value can be recovered from an aqueous solution in crystal form of uranium fluoride, uranium oxide, uranium ammonium fluoride and uranium potassium fluoride, etc.

(2) Economical recovery of uranium from wet phosphoric acid production process is capable and crude phosphoric acid after extraction operation is not contaminated.

(3) As various extractants are usable for extraction of uranium, corresponding to various changes of objective aqueous solution is possible.

(4) Uranium is recovered as an intermediate such as double salt of uranium ammonium fluoride and uranium potassium fluoride, etc. and it is easy to improve uranium purity owing to its fast crystallization velocity, easy dissolution and recrystallization operations.

(5) Production process to $UF_6$ and metallic uranium can be shortened.

(6) As total HF and $NH_3$ used for stripping uranium in the organic phase can be recycled, uranium extractive metallurgy in a place where it is difficult to obtain these resources is more convenient in comparison with other conventional processes.

This invention will be embodimently explained on the basis of the practical experimental example.

EXAMPLE

Figure 5:
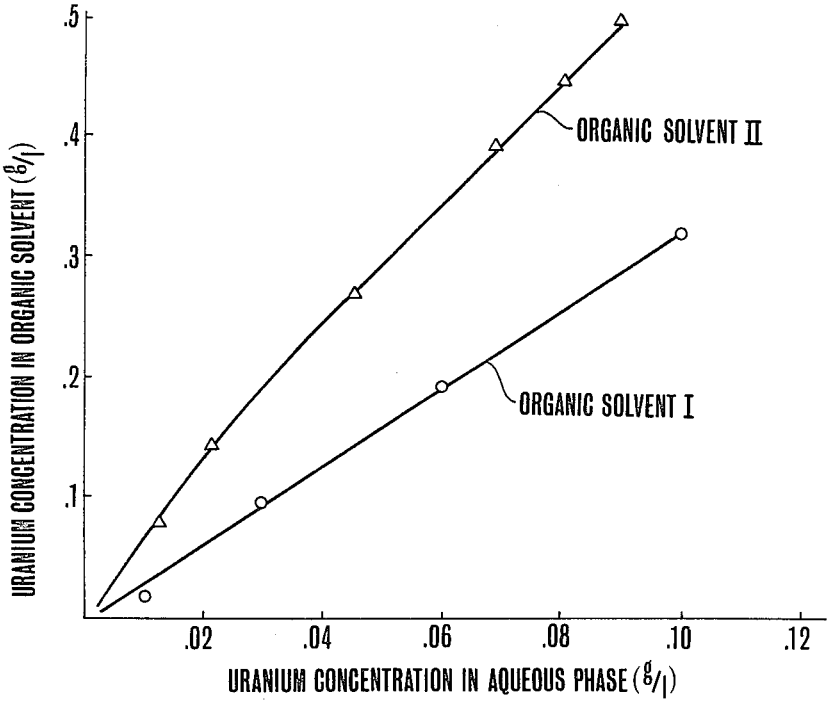
FIG. 5 is a graph showing uranium extraction isotherm with organic solvent.

FIG. 5 shows the extraction equilibrium curve of $U^{4+}$ and $U^{6+}$ ions from a phosphoric acid solution with organic solvent I (0.8M D2EHPA+0.03M TOPO in isoparaffine) and organic solvent II (0.6M D2EHDTPA+0.03M TOPO+0.4M OPPA in isoparaffine). Extraction conditions are set forth below. O/A ratio is 1.0/1.0, shaking time 10 minutes and temperature 23° C. Distribution ratio of $U^{4+}$ and $U^{6+}$ with organic solvent II (Δ—Δ line) was higher than one of organic solvent I (Δ—Δ line).

Subsequently stripping tests of uranium transferred to the organic phase were done. The same organic solvents were used in the stripping test in connection with the extraction test. The stripping condition was the same as the extraction condition. FIG. 6 shows relationship between concentration of strip solution ($(NH_4F)_2$ and $NH_4HF_2$) and pH. ●—● and ▲—▲ curves indicate the test was done in pH 8.2 and ○—○ and Δ—Δ curves indicate the test was done in pH 6.1.

Crystals of uranium ammonium fluoride and uranium acid ammonium fluoride were deposited for the first time by several repeated operations due to a small amount of uranium in the organic phase. Especially solubility of uranium acid ammonium fluoride in water was high.

$U^{6+}$ ions transferred to the aqueous phase are reduced by hydrazine or hydrazine compounds added beforehand to the strip solution and consequently uranium ammonium fluoride or uranium potassium fluoride crystal having low solubility in water is obtained and deposit operation becomes easy.

As shown in FIG. 6, stripability of uranium in the organic phase increases with enhancement of $NH_4F$ concentration. Rate of deposit as a crystal of uranium ammonium fluoride or uranium potassium fluoride from uranium transferred to the aqueous phase increases with increase of pH value, $NH_4HF_2$ or $KHF_2$ concentration and $U^{4+}$ ion concentration in coincidence with FIG. 6.

Figure 7:
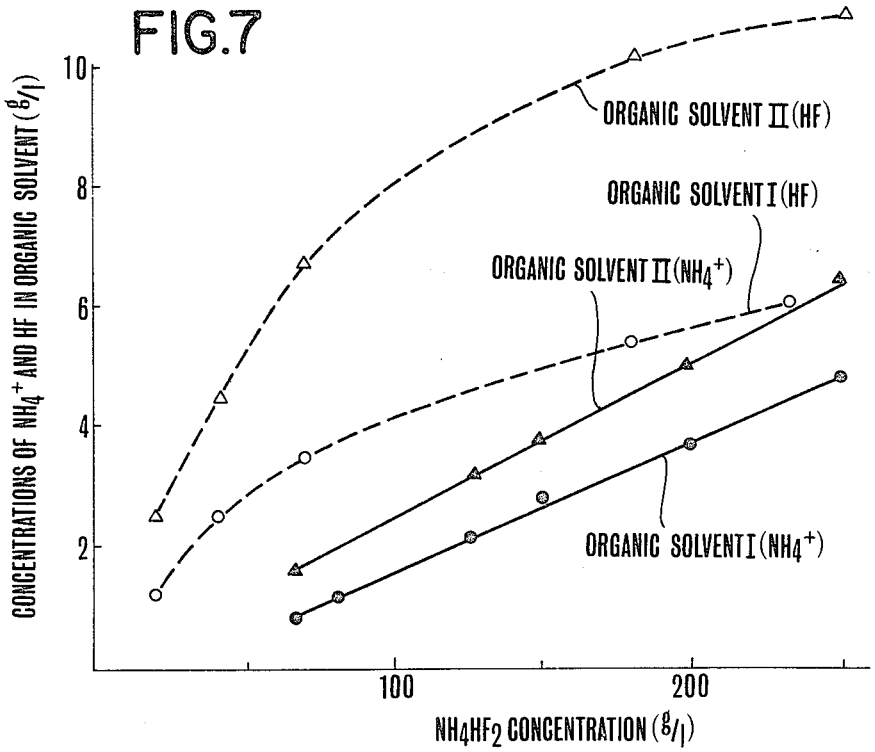
FIG. 7 is a graph showing the relationship between concentration of $NH_4HF$ and amount of $NH_4^+$ and HF extracted to the organic solvent.

FIGS. 7 and 8 show a remarkahble difference from Japanese Laid-Open Patent Application Sho 53-128596 in which HF in the strip solution is extracted to the organic solvent in the stripping stage of uranium in the organic phase, crude phosphoric acid is contaminated with contact of the organic solvent containing HF and consequently economical value reduces.

FIG. 7 shows the relationship between $NH_4^+$ and HF amounts extracted to the organic solvent and concentration of $NH_4HF_2$ strip solution. Stripping condition is the same as in FIG. 6 and the used two organic solvents are same. The pH value of the strip solution is 5.0-5.5. ●—● and ▲—▲ curves show $NH_4^+$ amount extracted to the organic solvent. ○—○ and Δ—Δ curves show HF amount extracted to the organic solvent. pH values are changed as shown in FIG. 8.

FIG. 8 shows the relationship between the pH value before stripping and amounts of $NH_4^+$ and HF extracted to the organic phase in the stripping stage of uranium in the organic phase. The pH values before stripping operation are controlled by adding $NH_3$ and $(NH_4F)_2$ or $NH_4HF_2$. ●—● and ▲—▲ curves show the $NH_4^+$ concentration (g/l) in organic solvents I and II, respectively. ▲—▲ and Δ—Δ curves show the HF concentration in organic solvent II.

It is found from FIG. 8 that HF concentration extracted to the organic phase is negligible by increase of pH value. Similar results can be obtained using alkyl amine extractant or organic solvent containing only neutral phosphoric acid ester.

The strip reaction of uranium extracted to the organic amine extractant is shown in the following equation.

$$(R_3NH)_4UO_2(SO_4)_3+6NH_4F \rightleftarrows 4(R_3N)+(NH_4)_4UO_2F_6\downarrow+2H_2SO_4+(NH_4)_2SO_4 \quad (20)$$

As shown in the above equation, free amine is formed and $4R_3.NH.F$ not formed.

As shown in the following expression, with regard to the relation between $H^+$ concentration and extractability of neutral phosphoric acid ester, $$HF.TOPO+NH_4F \rightleftarrows TOPO+NH_4HF_2 \quad (21)$$

HF.TOPO exists in a low pH region and TOPO in a high pH region. This phenomena is disclosed in Japanese Patent Publications Sho 52–13794 and Sho 56–3767 by these inventors and is coincident with the practical example shown in FIG. 8. Of course, the strip solution containing $KHF_2$ or KF showed the similar results.

In the case of double salt formation with organic extractant of alkyl amine and neutral phosphoric acid ester as shown in equations (1), (4) and (6), HCl, $HNO_3$ or $H_2SO_4$ is formed in the strip solution unlike equations (2), (3) and (5) of $U^{4+}$ and $UO_2^{2+}$ ions extraction in the stripping stage.

The influence on stripability is shown in Table 1.

TABLE 1

| Strip | | | Stripping percent | | |
|---|---|---|---|---|---|
| Acid | Acid concentration of added amount | $NH_4HF_2$ concentration | 10% TOA | 30% TBP | Organic solvent II |
| $H_2SO_4$ | 0.5N | 200 g/l | 98.1% | 98.6% | 87.4% |
| | 1.0N | " | 82.9 | 86.1 | 68.9 |
| HCl | 0.5N | " | 99.2 | 99.2 | 84.9 |
| | 1.0N | " | 96.4 | 96.0 | 69.1 |
| $HNO_3$ | 0.5N | " | 98.8 | 99.4 | 88.6 |
| | 1.0N | " | 94.7 | 94.9 | 60.3 |
| $(COOH)_2$ | 0.5N | " | 99.7 | 98.8 | 88.3 |
| | 1.0N | " | 90.1 | 81.8 | 70.8 |

where N: Normality.
Hydrazine is added as a reducing agent in all cases
Stripping Condition:
O/A ratio = 1.0,
Shaking time = 10 min.
Temperature: room temperature.

Figure 9:
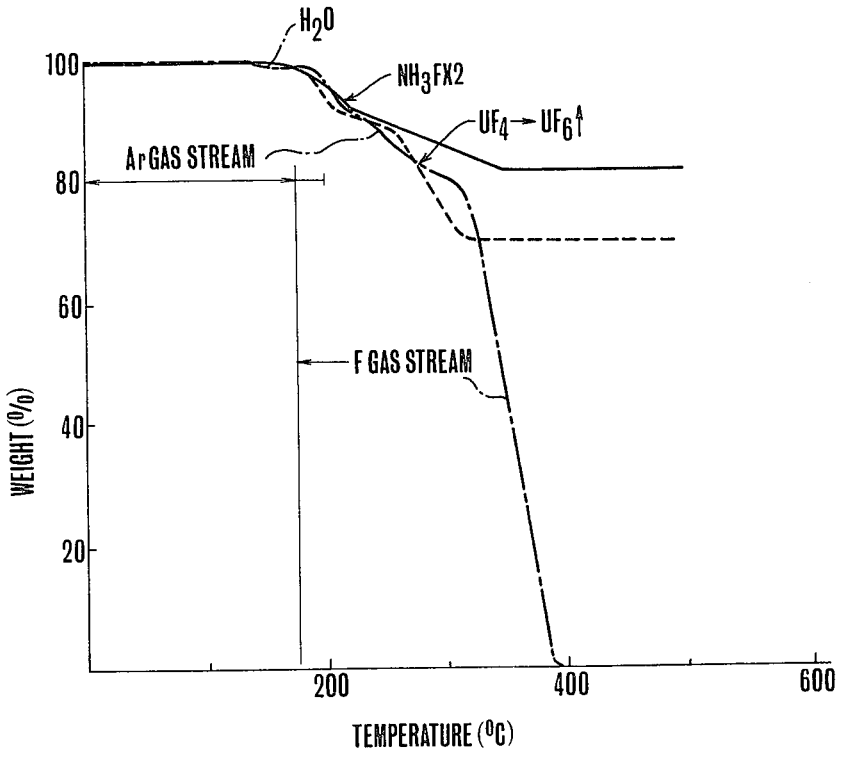
FIG. 9 shows the weight change in heating of uranium ammonium fluoride.

FIG. 9 shows the result of thermal decomposition of uranium ammonium fluoride obtained by stripping. In FIG. 9 — line indicates the thermal decomposition curve in inert gas stream ($N_2$, Ar), - - - line the same in $H_2O$-$O_2$ or air stream and -.-.- line the same in Ar-$F_2$ stream. The product obtained in the inert gas stream is $UF_4$, the product obtained in $H_2O$-$O_2$ or air stream is $UO_2$ and the product obtained in $F_2$ stream is $UF_6$.

Uranium ammonium fluoride used for the test was prepared as follows. $U^{4+}$ and $U^{6+}$ ions in a crude phosphoric acid containing 350 g/l of $H_3PO_4$ are extracted from the crude phosphoric acid with contact of organic solvent II and stripped from the organic phase with contact of a strip solution (pH 8.2) containing 250 g/l of $NH_4F$ and 20 g/l of hydrazine. Crystals obtained by repeated stripping operation for enhancement of uranium concentration in the strip solution are scrubbed by methanol, isopropyl alcohol and ketone in that order and dried at 80° C.

The sample obtained was determined as $(NH_4)_2UF_6$ by analysis. Of course, there are some cases in which $UF_4$ and $(NH_4)_4UO_2F_6$ are mixed with $(NH_4)_2UF_6$.

Uranium ammonium fluoride or uranium potassium fluoride in this invention is not always simple compound and are occasionally mixtures of various compounds.

As shown in FIG. 9, at first one part of crystal water is decomposed, decomposition of $NH_4F$ is started at 80°–230° C., remaining fluoride is decomposed at 240°–350° C. in $H_2O$-$O_2$ containing gas stream and uranium oxide is obtained. In thermal decomposition in gas stream containing fluorine, at first crystal water is decomposed and ammonium fluorine such as $NH_4F$ and $NH_4HF_2$ is decomposed at 80°–230° C. Formation of $UF_6$ based on the reaction $UF_4+F_2 \rightleftarrows UF_6\uparrow$ takes place at 300° C., rapidly proceeds at 350° C. and finishes at 400° C. Therefore, in this invention, $UF_6$ can be produced at a single stroke by decomposition of crystal water in inert gas stream and the following thermal decomposition in fluorine gas stream.

What we claim:

1. A process for the recovery of uranium comprising:
   (1) extracting uranium ions with an organic solvent containing one or more compounds selected from the group consisting of alkyl phosphoric acid, alkyl-aryl phosphoric acid, alkyl dithio phosphoric acid, aryl dithio phosphoric acid, neutral phosphoric acid ester and alkyl amine, together with a petroleum hydrocarbon as a diluent; and
   (2) stripping the uranium ions from the resultant organic solvent from step (1) into an aqueous phase by contacting said organic solvent with an aqueous solution comprising one or more compounds selected from the group consisting of $NH_4F$, $NH_4HF_2$, KF or $KHF_2$.

2. A recovery process according to claim 1 wherein uranium is extracted in said step (1) from an aqueous solution containing HCl, $H_2SO_4$, $H_3PO_4$, or $HNO_3$ and uranium.

3. A process for the recovery of uranium as uranium fluoride or uranium oxide comprising:
   (1) extracting uranium ions with an organic solvent containing one or more compounds selected from the group consisting of alkyl phosphoric acid, alkyl-aryl phosphoric acid, alkyl dithio phosphoric acid, aryl dithio phosphoric acid, neutral phosphoric acid ester and alkyl amine, together with a petroleum hydrocarbon as a diluent;
   (2) preparing uranium ammonium fluoride, uranium acid ammonium fluoride, uranium potassium fluoride or uranium acid potassium fluoride by stripping the uranium ions from the resultant organic solvent from step (1) by contacting with an aqueous solution containing one or more compounds selected from the group consisting of $NH_4F$, $NH_4HF_2$, KF and $KHF_2$; and
   (3) recovering the uranium as uranium fluoride or uranium oxide by heating the resultant uranium compounds in $H_2O$, oxygen, hydrogen or an inert gas stream.

* * * * *